US007259134B2

(12) United States Patent
Beckholt et al.

(10) Patent No.: US 7,259,134 B2
(45) Date of Patent: Aug. 21, 2007

(54) DETERGENT POUCH

(75) Inventors: Dennis Allen Beckholt, Fairfield, OH (US); Liben Hailu, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 391 days.

(21) Appl. No.: 10/860,466

(22) Filed: Jun. 3, 2004

(65) Prior Publication Data

US 2005/0003982 A1 Jan. 6, 2005

Related U.S. Application Data

(60) Provisional application No. 60/475,265, filed on Jun. 3, 2003.

(51) Int. Cl.
*C11D 17/04* (2006.01)
*C11D 3/44* (2006.01)

(52) U.S. Cl. ..... 510/296; 510/220; 510/406; 510/439; 510/505

(58) Field of Classification Search ..... 510/296, 510/220, 406, 439, 505
See application file for complete search history.

(56) References Cited

U.S. PATENT DOCUMENTS

| | | | | |
|---|---|---|---|---|
| 3,198,740 | A * | 8/1965 | Dunlop, Jr. et al. | 510/439 |
| 4,973,416 | A * | 11/1990 | Kennedy | 510/296 |
| 6,727,215 | B2 * | 4/2004 | Roberts et al. | 510/296 |
| 6,878,679 | B2 * | 4/2005 | Sommerville-Roberts et al. | 510/296 |
| 6,881,713 | B2 * | 4/2005 | Sommerville-Roberts et al. | 510/296 |
| 6,995,126 | B2 * | 2/2006 | Perkis et al. | 510/296 |
| 2002/0169092 | A1 * | 11/2002 | Catlin et al. | 510/220 |
| 2003/0087783 | A1 | 5/2003 | Somerville-Roberts et al. | |

FOREIGN PATENT DOCUMENTS

| | | | |
|---|---|---|---|
| EP | 1 364 610 | A1 | 11/2003 |
| EP | 1 394 065 | A1 | 3/2004 |
| JP | 09272773 | A * | 10/1997 |
| WO | WO 02/14460 | A2 | 2/2002 |
| WO | WO 02/42400 | A2 | 5/2002 |
| WO | WO 02/42401 | A2 | 5/2002 |
| WO | WO 02/42408 | A2 | 5/2002 |
| WO | WO 02/057402 | A1 | 7/2002 |
| WO | WO 03/038027 | A1 | 5/2003 |
| WO | WO 2004/018611 | A1 | 3/2004 |

* cited by examiner

*Primary Examiner*—Lorna M. Douyon
(74) *Attorney, Agent, or Firm*—Jeffrey V. Bamber; Laura R. Grunzinger

(57) ABSTRACT

Single or multi-compartment detergent pouch having walls composed of a water-soluble or dispersible water-containing polymer film, the pouch having at least one compartment containing a liquid composition and preferably at least one compartment containing a hygroscopic powder composition characterised in that the liquid composition comprises a moisture regulator system such that at equilibrium at 40% relative humidity and 21.1° C. (70° F.) the amount of water in the film is within about 30%, preferably within about 10% of that of the native film.

6 Claims, No Drawings

DETERGENT POUCH

CROSS REFERENCE

This case claims priority to U.S. Provisional Application No. 60/475,265 filed Jun. 3, 2003, which is incorporated by reference herein.

TECHNICAL FIELD

The present invention is in the field of detergency. In particular, it relates to single and multi-compartment detergent pouches made of a flexible water-soluble or dispersible polymer film material. The pouches of the invention have an improved strength and chemical stability when freshly made and after ageing under both low and high temperatures and low and high relative humidity conditions.

BACKGROUND OF THE INVENTION

The use of water-soluble pouches for different applications, especially for cleaning applications, has become increasingly popular. Among many other advantages pouches avoid the contact of the user with the cleaning composition which may contain bleach and/or other irritant substances. Single compartment detergent pouches are known in the art and are sold commercially. WO 02/14460 discloses pouches having a crushing resistance of at least 1 N at 23° C.

Multi-compartment detergent pouches containing compositions in different physical forms in separate compartments are also known in the art. WO 02/42400, WO 02/42401 and WO 02/42408 disclose a dual-compartment pouch wherein one of the compartments contains a liquid composition and the other compartment contains a composition in powder form.

A problem found in both single and multi-compartment pouches but especially in dual-compartment pouches having compositions in different physical forms is that the pouches can lose strength with time, leading to the risk of rupture under typical transport and storage conditions. This problem can be especially acute in the case of pouches containing hygroscopic powders and other compositions prone to absorb water from the environment. Pouches are usually packed in a single container, therefore the rupture of one pouch will detrimentally affect the remainder of the pouches packed in the same container.

Thus an object of the present invention is to provide liquid containing detergent pouches of improved strength. Another object is to provide detergent pouches whose strength does not decrease considerably with time. A further object is to provide multi-compartment liquid/powder pouches wherein both the liquid and the powder compartment have excellent physical strength and storage stability.

SUMMARY OF THE INVENTION

According to a first aspect of the invention, there is provided a single or multi-compartment detergent pouch having walls composed of a water-soluble, dispersible or frangible polymer film, said pouch having at least one compartment containing a liquid composition (which term includes liquids, gels, and pastes). Preferably at least one other compartment of the pouch contains a hygroscopic powder composition (which term includes densified powders, compact powders, agglomerates, tablets, etc). In preferred embodiments the liquid composition comprises a moisture regulator system such that at equilibrium at 40% relative humidity and 21.1° C. (70° F.), preferably at 80% relative humidity and 32.2° C. (90° F.), the amount of water in the film (averaged over the whole pouch film) is within about 30%, preferably within about 20% and more preferably within about 10% of that of the native film. The pouch is extremely strong when freshly made and the strength is substantially maintained over time. Without being bound by theory, it is believed that the moisture regulator system helps to maintain the natural elasticity of the film across the entire pouch. Preferably the moisture regulator system is also capable of maintaining the amounts of all the other liquid or mobile components in the film within about 30%, preferably within about 20%, more preferably within about 10% of the corresponding amounts in the native film under 40% relative humidity and 21.1° C. (70° F.), and preferably at 80% relative humidity and 32.2° C. (90° F.).

For the purpose of this invention the native composition of the film (and the amounts of the components thereof) is defined with respect to the film prior to the manufacture of the pouch, and immediately after the film has been equilibrated at 40% relative humidity and 21.1° C. for 12 hours. Preferably the film material used herein has a water content under these conditions of from about 4 to about 15%, preferably from about 5 to about 9% per weight of the film.

Equilibrium is defined herein as the point at which the composition and/or mechanical properties of the film or pouch (as appropriate) substantially reach steady state and do not change by more than 5%, preferably by more than 1% in a time period of one day when the pouch is exposed at 40% relative humidity and 21.1° C. In cases where these conditions are not fulfilled within a period of two weeks (14 days), equilibrium point herein is taken to be two weeks.

The water content of the film is measured by heating a fragment of the film at about 120° C., absorbing the water into dried methanol followed by Karl Fischer titration with Hydranal Composite 5.

For the purpose of this invention, hygroscopic powder composition means a powder composition capable of absorbing moisture from the environment, for example, a powder composition taking more than about 0.5%, preferably more than about 1% of water by weight of the composition at 40% relative humidity and 21.1° C. Moisture pick up is measured by dynamic vapour sorption according to a cycle wherein the relative humidity is increased from 0 to 80% at 21.1° C. Hygroscopic powders usually include hydratable ingredients such as inorganic salts, for example, phosphates, carbonates, silicates, sulfates, percarbonates, perborates and organic acids and its salts such as citric acid.

The moisture regulator system is a mixture capable of controlled absorption or desorption of water depending on the conditions of the surrounding environment. Preferably the regulator system comprises at least one component, and more preferably two components, capable of diffusing through the film. The components of the regulator system capable of diffusing through the film preferably have a molecular weight of less than about 100. In general terms, the moisture regulator system consists of a mixture of aqueous and/or non-aqueous hydrophilic solvent components.

Preferably the regulator system includes a C2-C6 monoalkylene polyol or a mixture thereof, preferably C2-C3 monoalkylene polyol having a preferred molecular weight of less than about 100. Preferred C2-C3 monoalkylene polyols for use herein include glycerol, ethylene glycol, propylene glycol and mixtures thereof, especially preferred being glycerol.

Other suitable components of the regulator system includes polyalkylene glycols, glycol ethers, glycol esters or a mixture thereof, preferably polyethylene and polypropylene glycols, glycol ethers, glycol esters and mixture therof, especially preferred being dipropylene glycol.

In a preferred embodiment the moisture regulator system comprises a C2-C6 monoalkylene polyol, preferably C2-C3 monoalkylene polyol or a mixture thereof and a polyalkylene glycol glycol ether, glycol ester, preferably polyethylene and polypropylene glycol or a mixture thereof in a weight ratio of from about 1:2 to about 1:30, preferably from about 1:4 to about 1:20, more preferably from about 1:5 to about 1:10. Pouches comprising this moisture regulator system maintain the water content of the film fairly constant from the moment at which the pouch is made, i.e., moisture equilibrium, as defined herein, is reached quickly or instantaneously.

Again in preferred embodiments the moisture regulator system comprises a C2-C6 monoalkylene polyol, preferably C2-C3 monoalkylene polyol or a mixture thereof and water in a weight ratio of from about 1:1 to about 1:10, preferably from about 1:2 to about 1:8.

Preferred from the view point of optimum moisture control and pouch strength are moisture regulator systems comprising a combination of monoalkylene polyol, polyalkylene glycol or derivatives thereof, and water. Thus, in a preferred aspect, the moisture regulator system comprises by weight of the system: a) from about 3 to about 40%, preferably from 5 to 15% and more preferably from about 6 to about 10% of a C2-C6 monoalkylene polyol or a mixture thereof; b) from about 20 to about 80%, preferably from about 25 to about 60%, more preferably from about 30 to about 45% of a polyalkylene glycol glycol ether, glycol ester or a mixture thereof; and c) from about 5 to about 30%, preferably from about 10 to about 25%, more preferably from about 15 to about 22% of water. This regulator system is optimum from both the control of water within the film and the rheology of the system. A favourable rheology facilitates the handling and the dosing of the system into the pouch. The moisture regulator system has a preferred viscosity range of from about 90 to about 1,000, preferably from about 100 to about 500 mPa s as measured using a Brookfield viscometer at 20° C.

The level of the moisture regulator system in the liquid composition is preferably from about 10 to about 90%, more preferably from about 20 to about 70% and yet more preferably from about 30 to about 50% by weight of the liquid composition. The liquid composition may further comprise detergency actives or auxiliaries.

The pouches of the invention preferably have an impact resistance after equilibrating at 40% relative humidity and 21.1° C. of at least 15 J, preferably at least 20 J and more preferably at least 30 J. The impact resistance is measured by placing a pouch inside of a ziplock bag. When the pouch is a dual-compartment solid/liquid pouch the pouch is placed with the liquid compartment up. A weight of 3.75 kg, having a circular impact flat face with a diameter of 5.7 cm, is dropped from a height of 4 cm onto the pouch. The energy per impact is calculated as:

$$\begin{aligned}\text{Energy/Impact} &= \text{Weight} * \text{Height} * \text{Gravity}\\ &= 3.75\ \text{kg} * 0.04\ \text{m} * 9.80\ \text{m/s}^2\\ &= 1.5\ J\end{aligned}$$

The weight is dropped repeatedly until the pouch breaks and the impact number at which the pouch breaks is recorded and multiplied by 1.5 J to get the total energy needed to break the pouch. The ziplock bag has no impact on the measured results.

According to another aspect of the invention, there is provided a single or multi-compartment detergent pouch having walls composed of a water-soluble, dispersible or frangible water-containing polymer film typically having a water content of from about 3 to about 16% by weight of the film at equilibrium, said pouch having at least one compartment containing a liquid composition comprising a moisture regulator system and preferably at least one compartment containing a hygroscopic powder composition. Preferably the pouches herein have an impact resistance at equilibrium of at least about 15 J, more preferably at least about 25 J and especially at least about 30 J.

Another aspect of the invention provides a single or multi-compartment detergent pouch having walls composed of a water-soluble, dispersible or frangible water-containing polymer film, said pouch having at least one compartment containing a liquid composition and preferably at least one compartment containing a hygroscopic powder composition, characterised in that the liquid composition comprises a moisture regulator system comprising by weight of the system: a) from about 4 to about 40%, preferably from 5 to 15% and more preferably from about 6 to about 10% of a C2-C6 monoalkylene polyol, preferably of a C2-C3 monoalkylene polyol or a mixture thereof; b) from about 30 to about 80% preferably from about 25 to about 60%, more preferably from about 30 to about 45% of a polyalkylene glycol glycol ether, glycol ester, preferably a polyethylene and polypropylene glycol or a mixture thereof; and c) from about 5 to about 30% preferably from about 10 to about 25%, more preferably from about 15 to about 22% of water.

Highly preferred herein are pouches wherein the mechanical properties of the film are also maintained after equilibration. Thus in a preferred embodiment, there is provided a pouch wherein at equilibrium at 40% relative humidity and 21.1° C. (70° F.), preferably at 80% relative humidity and 32.2° C. (90° F.), the elastic properties of the film (tensile strength, elongation modulus and percentage of elongation at break) are within about 40%, preferably within about 20%, more preferably within about 10% of those of the native film.

According to another aspect, there is provided a single or multi-compartment detergent pouch having walls composed of a water-soluble or dispersible water-containing polymer film, said pouch having at least one compartment containing a liquid composition and preferably at least one compartment containing a hygroscopic powder composition wherein the hygroscopicity of the native film is equal or higher than that of the liquid composition. By hygroscopicity herein is meant the weight of water per grams of the composition picked up at 40% relative humidity and 21.1° C. (70° F.). Hygroscopicity is measured by the dynamic vapour sorption method as described above. Balancing the hygroscopicity of the liquid composition versus that of the film in this way is valuable for ensuring optimum puch strength under varying storage conditions.

According to another aspect, there is provided a single or multi-compartment detergent pouch having walls composed of a water-soluble, dispersible or frangible water-containing polymer film, said pouch having at least one compartment containing a liquid composition and preferably at least one compartment containing a hygroscopic powder composition wherein the hygroscopicity of the native film is equal or higher than the average weight hygroscopicity of the liquid and the powder composition. By average weight hygroscopicity is defined as the hydroscopicity of the powder times weight of powder in the pouch plus the hydroscopicity of the liquid times weight of liquid in the pouch divided by the total weight of powder plus liquid in the pouch.

Preferably the pouches of the invention have a release profile such that at least about 80%, more preferably at least about 90% of pouch contents are released from the pouch within about 2 minutes, preferably within about 60 seconds and more preferably within about 30 seconds of the pouch being released from the washing machine dispenser into the dishwashing liquor. As described herein below the first film of the powder compartment has at least one pin-hole. Additionally the film is stretched when the pouch is in its equilibrium state being maintained in that state by the moisture control system. Without being bound by theory, it is believed that the combination of pin-hole/stretched film/and moisture control system contributes to the faster dissolution of the pouch.

DETAILED DESCRIPTION OF THE INVENTION

The present invention envisages single and multi-compartment pouches having walls composed of a water-soluble or dispersible water-containing polymer film. The pouches have at least one compartment containing a liquid composition and in highly preferred embodiments at least one compartment containing a powder composition. The liquid composition preferably comprises a moisture regulator system. The pouches of the invention are extremely strong and their strength does not substantially deteriorate with time.

Water-Containing Polymer Film

The pouch is generally made of a film material which is soluble or dispersible in water, and has a water-solubility of at least 50%, preferably at least 75% or even at least 95%, as measured by the method set out here after using a glass-filter with a maximum pore size of 20 microns.

50 grams±0.1 gram of film material is added in a preweighed 400 ml beaker and 245 ml±1 ml of distilled water is added. This is stirred vigorously on a magnetic stirrer set at 600 rpm, for 30 minutes. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the % solubility or dispersability can be calculated.

Preferred polymeric materials are those which are formed into a film or sheet. The pouch can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%.

Mixtures of polymers can also be used. This may in particular be beneficial to control the mechanical and/or dissolution properties of the compartment or pouch, depending on the application thereof and the required needs. For example, it may be preferred that a mixture of polymers is present in the material of the compartment, whereby one polymer material has a higher water-solubility than another polymer material, and/or one polymer material has a higher mechanical strength than another polymer material. It may be preferred that a mixture of polymers is used, having different weight average molecular weights, for example a mixture of PVA or a copolymer thereof of a weight average molecular weight of 10,000-40,000, preferably around 20,000, and of PVA or copolymer thereof, with a weight average molecular weight of about 100,000 to 300,000, preferably around 150,000.

Also useful are polymer blend compositions, for example comprising hydrolytically degradable and water-soluble polymer blend such as polylactide and polyvinyl alcohol, achieved by the mixing of polylactide and polyvinyl alcohol, typically comprising 1-35% by weight polylactide and approximately from 65% to 99% by weight polyvinyl alcohol, if the material is to be water-dispersible, or water-soluble. It may be preferred that the PVA present in the film is from 60-98% hydrolysed, preferably 80% to 90%, to improve the dissolution of the material.

Most preferred pouch materials are PVA films known under the trade reference Monosol M8630, as sold by Chris-Craft Industrial Products of Gary, Ind., US, and PVA films of corresponding solubility and deformability characteristics. Other films suitable for use herein include films known under the trade reference PT film or the K-series of films supplied by Aicello, or VF-HP film supplied by Kuraray.

The water-soluble film herein may comprise other additive ingredients than the polymer or polymer material and water. For example, it may be beneficial to add plasticisers, for example glycerol, ethylene glycol, diethyleneglycol, propylene glycol, sorbitol and mixtures thereof. Preferably the film of the pouch of the invention comprises glycerol as plasticisers. Other useful additives include disintegrating aids. It may be useful that the pouch or water-soluble film itself comprises a detergent additive to be delivered to the wash water, for example organic polymeric soil release agents, dispersants, dye transfer inhibitors.

The powder and liquid compositions herein can comprise one or more detergent active or auxiliary components. Detergent actives may be selected from traditional detergent ingredients such as builders, chelants, bleaching agents, surfactants, alkalinity sources, and enzymes. Detergent auxiliaries may be selected from finishing agents and care agents. Ingredients suitable for use herein are described herein below. Most of these ingredients can be used in both solid and liquid compositions. Usually the powder composition comprises ingredients in solid form and liquid ingredients carried onto the solid ingredients. Usually the liquid composition comprises liquid ingredients and can also comprise suspended solid particles.

Surfactant

Surfactants suitable for use here in are preferably low foaming by themselves or in combination with other components (i.e. suds suppressers). Surfactants suitable herein include anionic surfactants such as alkyl sulfates, alkyl ether sulfates, alkyl benzene sulfonates, alkyl glyceryl sulfonates, alkyl and alkenyl sulphonates, alkyl ethoxy carboxylates, N-acyl sarcosinates, N-acyl taurates and alkyl succinates and sulfosuccinates, wherein the alkyl, alkenyl or acyl moiety is $C_5$-$C_{20}$, preferably $C_{10}$-$C_{18}$ linear or branched; cationic surfactants such as chlorine esters and mono $C_6$-$C_{16}$ N-alkyl or alkenyl ammonium surfactants wherein the remaining N positions are substituted by methyl, hydroxyethyl or hydroxypropyl groups; low and high cloud point nonionic surfactants and mixtures thereof including nonionic alkoxylated surfactants (especially ethoxylates derived from $C_6$-$C_{18}$ primary alcohols), ethoxylated-propoxylated alcohols (e.g., BASF Poly-Tergent® SLF18), epoxy-capped poly(oxyalkylated) alcohols (e.g., BASF Poly-Tergent® SLF18B—see WO-A-94/22800), ether-capped poly(oxyalkylated) alcohol surfactants, and block polyoxyethylene-polyoxypropylene polymeric compounds such as PLURONIC®, REVERSED PLURONIC®, and TETRONIC® by the BASF-Wyandotte Corp., Wyandotte, Mich.; amphoteric surfactants such as alkyl amphocarboxylic surfactants such as Miranol™ C2M; and zwitterionic surfactants such as the betaines and sultaines; and mixtures thereof. Surfactants are typically present at a level of from about 0.2% to about 30% by weight, more preferably from about 0.5% to about 10% by weight, most preferably from about 1% to about 5% by weight of composition. Preferred surfactants for use herein are low foaming and include low cloud point nonionic surfactants and mixtures of higher foaming surfactants with low cloud point nonionic surfactants which act as suds suppresser therefor.

A preferred surfactant for use herein is an arnine oxide having the formula:

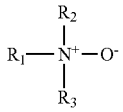

where $R_1$ is selected from an alkyl, hydroxyalkyl, acylamidopropyl and alkyl phenyl groups containing an average of at least 12 carbon atoms in the alkyl moiety; and $R_2$ and $R_3$ are independently selected from $C_{1-3}$ alkyl and/or $C_{2-3}$ hydroxyalkyl groups and polyethylene oxide groups containing from 1 to 3, preferably 1, ethylene oxide units. Preferred amine oxides are those wherein the $R_1$ alkyl moiety of the amine oxide contains an average of from 13 to 17 carbon atoms.

Preferred amine oxides from the view point of grease removal and filming and spotting reduction as well as for their environmental profile are tetradecyl dimethyl amine oxide, hexadecyl dimethyl amine oxide and mixtures thereof.

Builder

Builders suitable for use herein include builder which forms water-soluble hardness ion complexes (sequestering builder) such as citrates and polyphosphates e.g. sodium tripolyphosphate and sodium tripolyphosphate hexahydrate, potassium tripolyphosphate and mixed sodium and potassium tripolyphosphate salts and builder which forms hardness precipitates (precipitating builder) such as carbonates e.g. sodium carbonate. The builder is typically present at a level of from about 30 to about 80%, preferably from about 40 to about 70% by weight of composition.

Silicates

Silicates suitable for use herein include partially water-soluble or insoluble builders such as crystalline layered silicates and aluminosilicates inclusive of Zeolites A, B, P, X, HS and MAP.

Amorphous sodium silicates having an $SiO_2$:$Na_2O$ ratio of from 1.8 to 3.0, preferably from 1.8 to 2.4, most preferably 2.0 can also be used herein although highly preferred from the viewpoint of long term storage stability are compositions containing less than about 22%, preferably less than about 15% total (amorphous and crystalline) silicate.

Enzyme

Preferred enzymes for use herein include proteolitic enzymes such as Esperase®, Alcalase®, Durazym® and Savinase® (Novo) and Maxatase®, Maxacal®, Properase® and Maxapem® (Gist-Brocades). Other enzymes suitable for use herein include bacterial and fungal cellulases such as Carezyme and Celluzyme (Novo Nordisk A/S); peroxidases; lipases such as Amano-P (Amano Pharmaceutical Co.), M1 Lipase® and Lipomax® (Gist-Brocades) and Lipolase® and Lipolase Ultra® (Novo); cutinases; α and β amylases such as Purafect Ox Am® (Genencor) and Termamyl®, Ban®, Fungamyl®, Duramyl®, and Natalase® (Novo); pectinases; and mixtures thereof. Enzymes are preferably added herein as prills, granulates, or cogranulates at levels typically in the range from about 0.0001% to about 4% pure enzyme by weight of composition.

Bleaching Agent

Bleaching agents suitable for use herein include chlorine and oxygen bleaches, especially inorganic perhydrate salts such as sodium perborate mono-and tetrahydrates and sodium percarbonate optionally coated to provide controlled rate of release, preformed organic peroxyacids and mixtures thereof with organic peroxyacid bleach precursors and/or transition metal-containing bleach catalysts (especially manganese or cobalt). Inorganic perhydrate salts are typically incorporated at levels in the range from about 1% to about 40% by weight, preferably from about 2% to about 30% by weight and more preferably from abut 5% to about 25% by weight of composition. Bleaching agents are preferably incorporated into detergent compositions in solid form.

Method of Manufacturing

The single compartment pouches of the invention can be made by placing a first piece of film in a mould, drawing the film by vacuum means to form a pocket, filling the formed pocket with a liquid composition, preferably including the moisture regulator system, and placing and sealing the formed pocket with another piece of film.

The multi-compartment pouches of the invention can be made by placing a first piece of film in a mould, drawing the film by vacuum means to form a pocket, pinpricking the film, dosing and tamping the powder composition, placing a second piece of film over the first pocket to form a new pocket, filling the new pocket with the liquid composition, preferably including the moisture regulator system, placing a piece of film over this liquid filled pocket and sealing the three films together to form the dual compartment pouch.

EXAMPLES

Abbreviations used in Examples

In the examples, the abbreviated component identifications have the following meanings:

STPP: Sodium tripolyphosphate

Silicate: Amorphous Sodium Silicate ($SiO_2$:$Na_2O$=from 2:1 to 4:1)

Percarbonate Sodium percarbonate of the nominal formula $2Na_2CO_3.3H_2O_2$

Carbonate: Anhydrous sodium carbonate

Termamyl: α-amylase available from Novo Nordisk A/S

FN3 protease available from Genencor

SLF18: Poly-Tergent® available from BASF

Neodol non-ionic surfactant of formula $C_{11}H_{23}EO_9$ available from Olin Corp.

Duramyl: α-amylase available from Novo Nordisk A/S

DPG: dipropylene glycol

In the following examples all levels are quoted as percent (%) by weight.

Examples 1 to 3

The compositions of examples 1 to 3 are introduced in a two compartment layered PVA rectangular base pouch. The dual compartment pouch is made from a Monosol M8630 film (supplied by Chris-Craft Industrial Products) having a water content of 7.5% by weight of the film after equilibrating the film at 40% relative humidity and 21.1° C. for 12 hours. 19 g of the particulate composition and 2 g of the liquid composition are placed in the two different compartments of the pouch. The pouch is manufactured as described herein above (a more detail description of the process of manufacture is found in WO 02/42408). The water content of the film after equilibration averages about 7% by weight of the film.

The impact resistance of the pouches is calculated as described herein above after storing the pouches for two weeks at 40% relative humidity and 21.1° C. As it can be seen from table 1 the exemplified pouches are extremely strong even after two weeks storage.

TABLE 1

| | Example | | |
|---|---|---|---|
| | 1 | 2 | 3 |
| Particulate composition | | | |
| STPP | 40 | 40 | 40 |
| Carbonate | 30 | 30 | 30 |
| Silicate | 8 | 8 | 8 |
| Termamyl | 1.5 | 1.5 | 1.5 |
| FN3 | 2.5 | 2.5 | 2.5 |
| Percarbonate | 15 | 15 | 15 |
| SLF18 | 2 | 2 | 2 |
| Perfume | 1 | 1 | 1 |
| Liquid composition | | | |
| DPG | 40 | 40 | 40 |
| Glycerine | 4 | 15 | 7 |
| SLF18 | 44 | 32 | 40 |
| C11E9Neodol | 2 | 3 | 3 |
| Water | 10 | 10 | 10 |
| Impact resistance (J) | 33 | 38 | 31 |

What is claimed is:

1. A multi-compartment detergent pouch having walls comprised of a water-soluble or dispersible water-containing polymer film comprising a native film, said pouch having at least one compartment containing a liquid composition and at least one compartment containing a hygroscopic powder composition, wherein said liquid composition comprises a moisture regulator system comprising by weight of the system: a) from about 4 to about 40% of at least one C2-C6 monoalkylene polyol or a mixture thereof; b) from about 30 to about 80% of at least one polyalkylene glycol glycol, ether, glycol ester or a mixture thereof; and c) from 15 to about 30% of water.

2. A pouch according to claim 1 wherein the water content of the native film is from about 4 to about 15% by weight thereof.

3. A pouch according to claim 1 wherein the level of said at least one C2-C6 monoalkylene polyol or mixture thereof is from 5 to 15% by weight of said liquid composition.

4. A pouch according to claim 1 wherein at equilibrium at 40% relative humidity and 21.1° C. (70° F.), the elastic properties of the film are within about 40% of those of said native film.

5. The multi-compartment pouch of claim 1 wherein the moisture regulator system has a viscosity range of from about 90 to about 1000 mPa s.

6. The multi-compartment pouch of claim 1 wherein the moisture regulator system has a viscosity range of from about 100 to about 500 mPa s.

* * * * *